US006527479B1

(12) United States Patent
Courtney et al.

(10) Patent No.: US 6,527,479 B1
(45) **Date of Patent: *Mar. 4, 2003**

(54) BREAK AWAY COUNTERWEIGHT WITH NEUTRALIZING BUOYANCY OFFSET FOR DIVER'S SAFETY

(76) Inventors: William L. Courtney, 1990 Hwy. One, Elk, CA (US) 95432; Robert Manuel Carmichael, 940 NW. 1st St., Ft. Lauderdale, FL (US) 33311

( * ) Notice: Subject to any disclaimer, the term of this patent is extended or adjusted under 35 U.S.C. 154(b) by 0 days.

This patent is subject to a terminal disclaimer.

(21) Appl. No.: 09/812,621

(22) Filed: Mar. 19, 2001

Related U.S. Application Data

(63) Continuation-in-part of application No. 09/238,655, filed on Jan. 26, 1999, now Pat. No. 6,203,246.

(60) Provisional application No. 60/072,648, filed on Jan. 27, 1998.

(51) Int. Cl.[7] ..... B63C 11/00; B63C 9/00

(52) U.S. Cl. ..... 405/185; 405/186; 441/80; 441/88

(58) Field of Search ..... 405/185, 186; 441/80, 88, 106, 92, 96, 114–119; 114/315

(56) References Cited

U.S. PATENT DOCUMENTS 1,468,464 A * 9/1923 Elias ..... 441/115
1,480,417 A * 1/1924 Potter ..... 441/114
2,744,979 A * 12/1956 Moran ..... 441/94
3,670,059 A * 6/1972 Walters ..... 405/186
3,811,144 A * 5/1974 Yamanka ..... 441/80 X
3,967,459 A * 7/1976 Denis ..... 405/186
4,455,718 A * 6/1984 Finnern ..... 405/186
4,623,316 A * 11/1986 Ratliff ..... 441/106
4,681,552 A * 7/1987 Courtney ..... 441/115 X
4,778,307 A * 10/1988 Faulconer ..... 405/186
4,779,554 A * 10/1988 Courtney ..... 114/315
5,030,153 A * 7/1991 Bailey ..... 441/106 X
5,199,820 A * 4/1993 Nicklo ..... 405/186
5,516,233 A * 5/1996 Courtney ..... 405/186
5,567,084 A * 10/1996 Oliver ..... 405/186
5,855,454 A * 1/1999 Courtney et al. ..... 405/186
6,203,246 B1 * 3/2001 Courtney et al. ..... 405/185

* cited by examiner

*Primary Examiner*—Jong-Suk (James) Lee
(74) *Attorney, Agent, or Firm*—Malin, Haley & DiMaggio, P.A.

(57) ABSTRACT

A water safety and survival system is disclosed that provides a multi-chambered personal flotation device and break away counterweight that provides a heads-up righting moment that reliably positions a scuba diver's airway out of the water when at the surface, and provides for a comfortable heads down position during the dive. The break away counterweight stows the ballast needed to heel the diver into a heads up position in an inactive state. Once released, the counterweight drops away and becomes capable of actively rolling the diver's face out of the water into the heads up position. The counterweight is preferably utilized in conjunction with a buoyancy compensator that further provides for rotation of the diver into a heads up orientation, and that can provide buoyancy compensation for the counterweight.

13 Claims, 9 Drawing Sheets

BREAK AWAY COUNTERWEIGHT WITH NEUTRALIZING BUOYANCY OFFSET FOR DIVER'S SAFETY

CROSS-REFERENCE TO RELATED APPLICATIONS

This application is a continuation-in-part of U.S. application Ser. No. 09/238,655, filed Jan. 26, 1999, now. U.S. Pat. No. 6,203,246, which claims the benefit of U.S. Provisional Application No. 60/072,648, filed Jan. 27, 1998.

STATEMENT REGARDING FEDERALLY SPONSORED RESEARCH OR DEVELOPMENT

Not applicable.

BACKGROUND OF THE INVENTION

1. Field of the Invention

The present invention relates to water safety gear including life vests and integrated rescue products, adapted for use by scuba divers, and more particularly to a system having sequential deployment of a tank mounted counterweight, a forward buoyant chamber, and/or a partial ballast release combined with multiple visual and audible alerting devices.

2. Description of Related Art

Non-releasable tank mounted ballast as disclosed in issued U.S. Pat. Nos. 5,516,233 and 5,855,454 ("the '233 and '454 Patents"), the disclosures of which are incorporated herein by reference, is significantly advanced by the disclosure herein of a neutral airway protective device. Patents cited in the '233 and '454 Patents illustrate: tank mounted ballast, issued BC with horse collar and with hybrid personal floatation device "PFDI" (neoprene+inflatable component), and soft pouch.

Two of the primary complaints that have obstructed the fixed counterweight/ballast's airway protection from being embraced by all divers are (1) unacceptable deterioration in underwater diving comfort, and (2) loss or reduction of releasable ballast. During the first half of the dive, the non-releasable tank mounted counterweight, shown in the '233 and '454 Patents, is affixed to the rear of the tank, and thus, continually attempts to roll the diver over underwater, either left or right.

Numerous scuba diving fatalities occur in training or during the first year of diver experience. For these divers, their gear must be setup BEFORE they start a dive with a fixed counterweight which provide 100% reliable airway protection from the beginning to the end of their dive, independent of any action on their part. By analogy the beginning sky diver is protected from fainting or panics, by being attached to the plane and thus their gear will protect them if they fail to operate the rip cord for any reason. By sharp contrast, the advanced sky diver, only after the acquisition of experience, is allowed to assume full responsibility for opening their parachute. If the advanced sky diver faints or panics and consequently fail to pull their rip cord, death is nearly inevitable with the exception of in air rescues or acts of God. The free sky diver accepts the consequences of configuring their gear such that it transfers to them 100% responsibility for pulling their rip cord. Similarly, the advanced scuba diver for comfort and performance reasons may insist on diving a face down dive jacket i.e. a dive jacket that stabilizes the diver in an airway submerging surface position 90% of the time. In fact many advanced scuba divers absolutely refuse to dive with an attached fixed counterweight because its deterioration of comfort and performance exceed their desire for airway protection.

After unacceptable deterioration in dive comfort, the second most common reason divers refuse routine use of airway protective counterweighting is the loss or marked reduction of releasable ballast. This rejection of reliable airway protection is most often heard from warm water divers who do not require buoyant thermal protection and therefore they maybe diving with very little ballast on their weight belts. The addition of a counterweight as required to provide reliable surface airway protection can equal or exceed the amount of ballast currently worn by some divers as a function of tank buoyancy, diver body types, and selected gear. Even if the counterweight does not exceed the diver's total weight, there is often concern regarding the counterweight's conversion of any releasable weight belt ballast into non-releasable tank-mounted ballast. Their position fears the loss of the diver's ability to rapidly gain positive buoyancy as occurs when the weight belt is dropped. Some instructors teach that the value of releasable ballast in accident prevention exceeds the value gained from improved airway protection.

Deployment of a diver's Personal Flotation Device ("PFD") results in rapid and nearly irreversible shift towards excessive buoyancy. Only if the diver is in sufficient control to disconnect the quick release inflation hose or to detach and release the PFD itself at depth, can the diver reverse the impact of the PFD's deployment on their ascent rate. The PFD's deployment at depth will add enough net buoyancy to expose the diver to an increased risk of accelerated ascent rates, rates where even with the diver's glottis open, certain areas of the lungs may not able to safely depressurize. Since alveolar wall rupture occurs with pressure differential as low as 3.5 fsw, this relatively small differential can build up due to inconsistencies in pulmonary parenchyma in which collapse of small airways obstructs down stream alveoli, which then rapidly over inflate and rupture.

Alveolar rupture, introduces gas emboli into the arterial blood supply creating Arterial Gas Emboli ("AGE"). These gas bubbles proceed to all organs but the tissues most sensitive to even transient hypoxemia are the coronary and central nervous system. Coronary and Cerebral Arterial Gas Emboli ("CCAGE") obstructs end organ blood flow, infarcting down stream tissue. The primary presentation of Cerebral AGE is Loss Of Consciousness ("LOC") which renders the diver unable to participate in protecting his or her airway, making the distressed diver total dependent upon their dive gear. Cerebral AGE with its ability to infarct the brainstem which drives respiration and other vital physiology, is clearly associated with repeated, unpredictable, and untreatable fatalities that occur during buoyant ascent. The U.S. Navy, even under ideal conditions such as in buoyant ascent training in water filled tubes with on-line decompression chambers for the immediate treatment of CCAGE, suffered so many fatalities that non-war time ascent training was terminated because of it's untenably lethality. Director of National Underwater Accident Data Center estimates that 50% of diver fatalities begin as CCAGE, but the secondary filling of the lungs with water, inadvertently leads to the identified cause of death by the coroner as drowning. Thus, the numerous efforts disclose, the requirement to safely separate the high lift surface buoyancy needs of the PFD chamber from the low lift buoyancy needs of the underwater buoyancy compensation chamber.

In view of the above, it is therefore to the effective resolution of the aforementioned problems and shortcomings that the present invention is directed.

BRIEF SUMMARY OF THE INVENTION

The present invention provides for a combined ballasting and buoyancy device which allows a diver to simultaneously add a 6 lb counterweight and a 6 lb cervical pillow, to provide a neutral airway protective positioning system that is capable of improving the diver's chance of reducing equipment stabilized airway submersion. In diving, a rigorous water intensive activity, where 50% of the drownings occur at the surface, the improvement in airway protection constitutes a marked innovative advance in diver safety. The disclosed device overcomes the above-described complaints that have obstructed the fixed counterweight's airway protection from being embraced by all divers. The break away counterweight stows the counterweight in an inactive state close to the diver's axis of rotation until released. The disclosed addition of an adjustable but preset buoyant device offsets the counterweight's ballast, allowing the diver to retain the same size releasable weight belt. In a preferred embodiment, the buoyant device places a small bladder right behind the diver's neck optimizing clearance above the waters surface and hyper-extending the neck to facilitate self rescue, thus, further improving the reliability of airway protection in the event of diver distress. The bladders simplicity of design, operation and construction reduces it chances of rupture or failure supplying an unprecedented level of redundancy to airway protection.

The disclosed break away counterweight allows the diver both dive performance and improved airway protection based on the diver's confidence that they are capable of pulling the rip cord in the event of an emergency. For the advanced diver who steadfastly refuses to dive with a counterweight the current product fills a life threatening void.

Some of the advantages of the various embodiments of the present invention include, but are not limited to (1) providing an inflatable PFD with, a releasable Ballast member and/or non-releasable Ballast member; (2) providing a Combined Ballast & Buoyancy Device with (a) Independent single or multiple ballast means; (b) Multiple Position Ballast means, (c) Inflatable or inherently independent buoyant means; and (d) Dual Position ballasting means that stows closer to the longitudinal axis of rotation to be released dropping to a second, posterior point of attachment where the same amount of ballast supplies sufficient energy in combination with attached buoyancy to supply an airway protective righting moment; (3) Ballast means single or multiple, attached by fabric, spring steel, or rigid arm that can occupy two or more different radii from the combined axis of rotation; (4) A combined ballast and buoyant device that can be adjusted to be neutral, buoyant or negative as needed to balance the diver's gear. Through its adjustable specific separation of the ballast and buoyant moments within the device it creates a single stabilized surface position; (5) Combined ballast and buoyant device that non-releasably attaches the specific ballast and buoyancy required, by particular diver and his or her gear, to orient in gravity all other sources of attached ballast and buoyancy into a single stabilized righting moment or heads up direction when the diver is unable to maintain heads up positioning; (6) A combined ballast means and buoyant means used to balance all other attached buoyancy and ballast, thereby supplying a single stable surface position, either across the entire dive or only upon release. The buoyant means can be either bladder or foam that can be adjusted to provide, for example, 2, 4 or 6 lbs lift independently or in combination with a fixed non-releasable tank mounted counterweight, or in combination with a multi-position dual function ballast means; (7) in one embodiment, an orally inflated bladder that is built into the diver's jacket or added on to an existing jacket to create or focus the buoyant energy about the diver's neck. The bladder could be inflated by compressed gas either in an auxiliary cylinder or from the diver's air supply. If attached to the diver's air supply further inflation could be provided during, at the end or in an emergency; (8) in another embodiment, the fixed buoyant means could be supplied by the partial inflation of float or raft such as might be stowed in the diver's jacket, additionally serving to pad the diver from the rigid air cylinder; (9) once the 4 to 6 pounds of cervical flotation is contained additional buoyancy can be added between the diver and tank, along the sides of the tank or in the shoulder straps or chest area. One such combination would allow closed cell foam to be layered beneath the shoulder traps where its buoyancy contributes primarily to the heads up moment; (10) Additional buoyant means provided by bladders or foam could be located along the tank close to the axis of self rescue rotation. In this position the offset buoyancy's contribution to stabilized airway submersion is reduced relative to the buoyant moment created by the BC which is further outboard and therefore on a longer arm where pound for pound it powerfully creates stabilized airway submersion. In particular, certain buoyancy compensators, such as those with large back mount bladders require very large counterweights, in the range of 18 to 20+ lbs, to achieve 100% airway protection. Comfortable airway protection can be achieved by placing 6 lb by the neck area, moving 12 lbs of the buoyant moment in towards the axis of rotation by use of bladder or foam, adding 30% (6 lb) fixed counterweight to the back of the tank and, 70% (12 lb) dual position counterweight. Thus, the diver redistributes 18 lbs of buoyancy and 18 pounds of ballast, maintains their previous releasable ballast and achieves a 100% reliable airway positioning; (11) Inherently buoyant material or inflatable Bladder can be used to: (a) only offset the ballast needed to protect the diver's airway, i.e. allow the diver to maintain the same size releasable weight belt prior to adding the neutral buoyant ballast and buoyant device, (b) sized to provide greater than or equal to 4 lbs lift, the published minimum needed to position the diver's nose and mouth above the surface of the water, and (c) position by design and location to wrap around and support the flaccid diver's neck in the optimal surface position; (12) counterweight and the buoyancy needed to support the neck. When the device provides the 4 lbs net buoyancy or when combined with other dive gear providing the diver with 4 lbs net buoyancy such as from buoyant thermal insulation or inflatable dive jacket; (13) A scuba tank adapted to non-releasably attach a portion of the divers ballast, first close to the diver's axis of rotation where it functions as a ballasting means then released where the same ballast supplies the energy to rotate the diver; (14) Release means can be a combination of manual or automatic with manual override. A release mechanism in which the pouch that is contains high density particulate matter such as metal shot has mounting means on the side facing the tank so the attachment point is tangential to the circumference of the tank. Allowing attachment that does not produce elevation of straps above the tank where they might snag kelp; (15) Pouch to contain a stiffener to keep pouch from flopping away from the surface of the tank; and (16) Strap for attaching pouch to the tank that has anterior posterior positioning means so that the ballast can be adapted to a wide variety of dive jacket designs. Hook and loop turning through an opening in the pouch allows the ballast to be infinitely positioned along the anterior-lateral face of the tank. Alternatively, a series of receptacles arranged around the circumference of the tank band could receive a pin attaching the ballast in a variety of positions.

Thus, a water safety and survival system is disclosed that provides a multi-chambered personal flotation device and break away counterweight that provides a heads-up righting moment that reliably positions a scuba diver with his/her airway out of the water when at the surface, and provides for a comfortable heads down position during the dive. The scuba diver retains full control and responsibility for conversion of the equipment from face down flotation into face up flotation. The break away counterweight stows the ballast needed to heel the diver into a heads up position in an inactive state, close to the diver's longitudinal axis of rotation. Once released, the counterweight drops away from neutralized central attachment near the diver's axis of rotation out towards the counterweight's posterior attachment point. The counterweight then becomes capable of actively rolling the distressed diver's face out of the water into the heads up position. The counterweight is preferably utilized in conjunction with a buoyancy compensator that further provides for rotation of the diver into a heads up orientation, and that can provide buoyancy compensation for the counterweight. A SCUBA diving personal flotation device combined with buoyancy compensator relying upon redundant and reversible dual position dual function break away counterweight/keel is also provided by the present invention.

In accordance with these and other objects which will become apparent hereinafter, the instant invention will now be described with particular reference to the accompanying drawings.

DETAILED DESCRIPTION OF THE INVENTION

Figure 1:
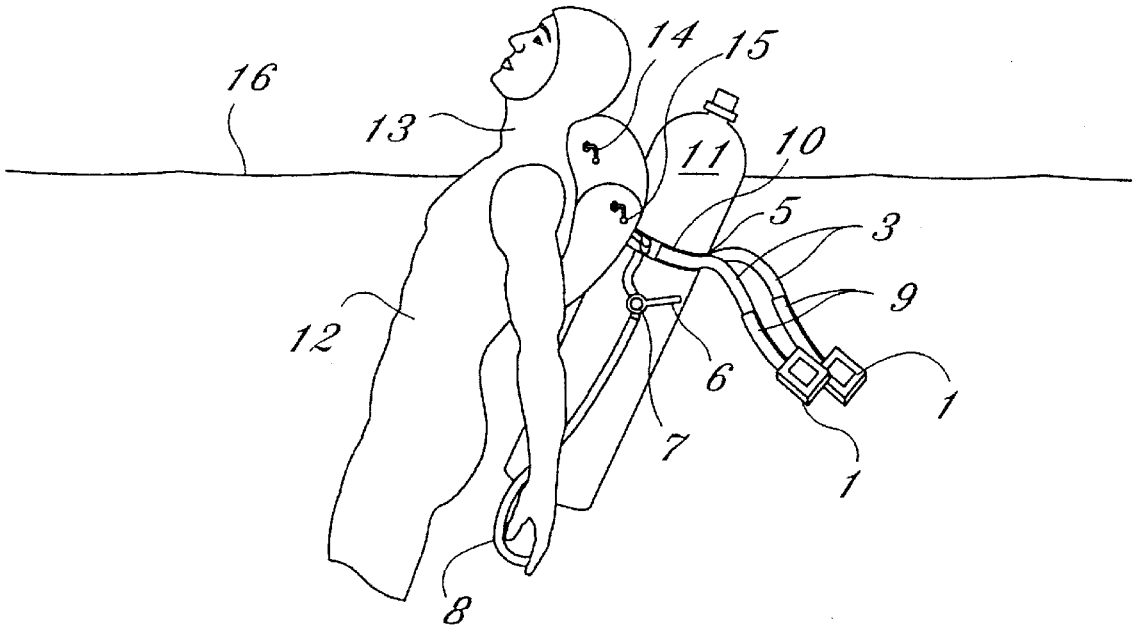
FIG. 1 is a perspective view of one embodiment of the present invention in use at the surface.
Figure 2:
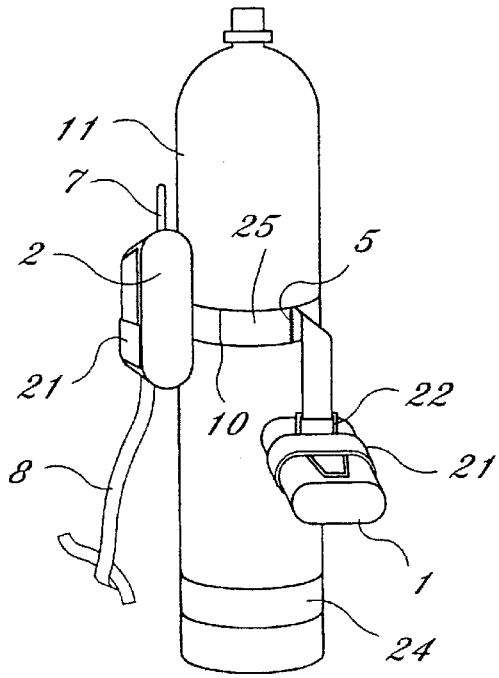
FIG. 2 is a perspective view of one embodiment of the present invention illustrating a first counterweight in the inactive or stowed position and a second counterweight in the active or deployed position.
Figure 3:
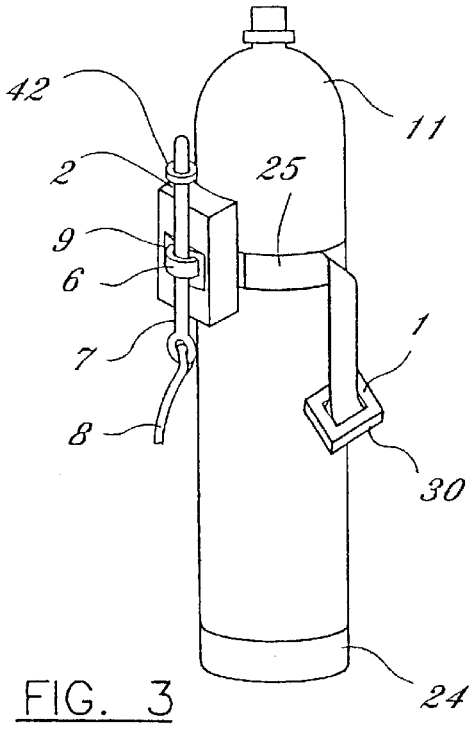
FIG. 3 is a perspective view of one embodiment of a quick release mechanism.
Figure 4:
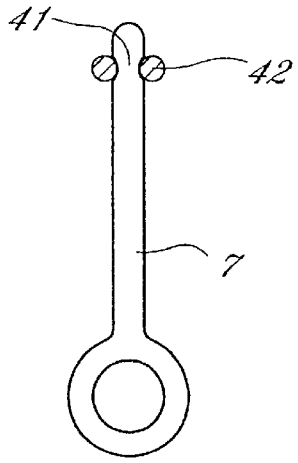
FIG. 4 is side elevational view of the quick release pin of that shown in FIG. 3.
Figure 5:
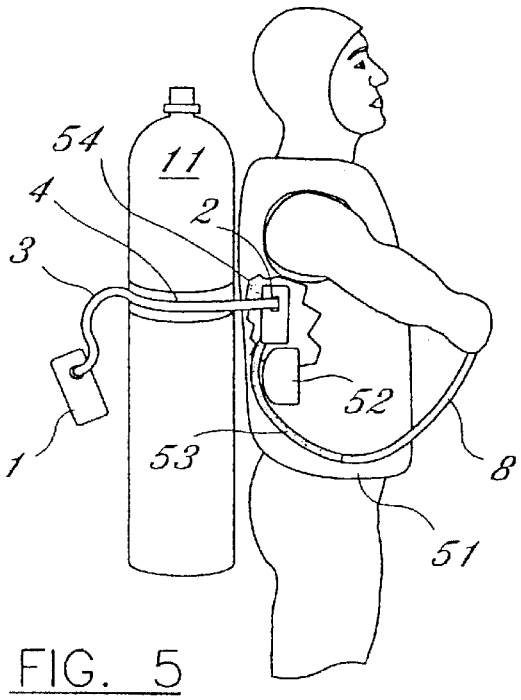
FIG. 5 is a perspective view of that of FIG. 3 in use with a buoyancy compensator.

As seen in FIGS. 1–9 a break away counterweight assembly is illustrated and shows a counterweights or ballast member 1 and/or 2 depending if the counterweight is in a released position or a stowed position. Break away counterweight 1 or 2 can be shaped to conform to the specific dive jacket, dive tank, air cylinder or back plate or alternatively can be made of standard design. The use of a dive tank or air cylinder, such as an aluminum tank 11, allows the split counterweight 1 or 2 to be magnetic as long as it kept separate from any dive electronics. However, it is not required that counterweight 1 or 2 be magnetic and other materials and properties for counterweight 1 and/or 2 can be used and are considered within the scope of the invention.

After release, the magnetic counterweight 1 connects to its polar opposite forming a unified centrally located counterweight 1, optimizing its efficacy. Release exposes the inside of the break away counterweight 1 and its swing arm 3 both serving as a visual alert. In one alert embodiment a Ballast Mediated Airway Protection ("BMAP") logo, which can be similar to a conventional tank warning logo, can be affixed to the inside and can identify the user as trained in "optional" airway protection. The suddenly exposed area which can also be a military specified brilliant orange webbing (FIG. 13) or fabric and/or reflective mylar, alerts the diver's buddy or dive master that the diver is at least low on air or possibly in need of assistance and warrants additional attention.

A release mechanism, which can include a pullpin 7 (FIG. 4), of the break away counterweight 1 or 2 is preferably a simple, single hand operation. The counterweight release mechanism can be a separate rip cord, such as rip cord 8 (FIGS. 2, 3, 5–7 and 11) which can be clipped at one end to an accessible D-ring. Alternatively, the counterweight's release mechanism is the first step of a single sequential release maneuver that connects overlapping components whose consecutive release strengthen the establishment of airway protection.

In one embodiment, the counterweight release is connected to a centrally located forward flap accessible from either hand. The first portion of operation releases only the counterweight and preferably occurs near the end of every dive. Activation of this release displays a partial visual alert notifying diver's in front just as the counterweight's straps and back side notify the divers behind that the diver is nearing the end of their air supply. Typically, a 80 cu ft tank, such as tank 11, starts out with 6 lbs of air which is lost through exhalation during the dive and thus results in a 6 pound shift towards increased buoyancy. This increased buoyancy is on the back of the diver, such as diver 12, creating if not facilitating face down flotation. Deployment of the 6 lb counterweight at this point returns the buoyancy of tank 11 to a full state simulating a safe tank or cylinder 11.

If the diver is at the surface and wishes additional lift because of surface conditions, extending the action into its second phase releases the forward chamber of a Multifunction Compensator, such as a multifunction compensator as described in the '233 and '454 Patents. As the forward chamber inflates, it's buoyancy summates with the relocation of released counterweight 1's ballast accelerating the overall shift in the diver's balance towards face up. The buoyant forward bladder, while not essential or separately sufficient to complete the self rescue roll, noticeably increases the rate of rotation during the first quadrant of rotation. If the diver were to become distressed and end up in a face down position, the forward buoyant moment aggressively seeks the surface, powering the distressed diver quickly through the first phase of the self rescue roll. The first quadrant is completed when the unconscious diver has been rotated from face down into the side high surface position. In this position, though diver 12's airway remains submerged. However, once in the side high surface position, if the tank mounted counterweight has been released, it's posterior attachment point optimally positions the ballast where it can lever diver 12 through the second quadrant of the self rescue rotation from side high to face up, thus stabilizing the distressed diver 12 in the airway protected face up position (FIG. 1).

Figure 13:
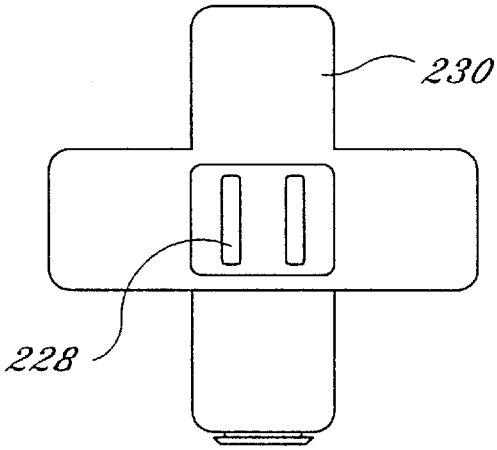
FIGS. 13 through 21 illustrate various embodiments for ballast release, buoyant deployment, and break away counterweight release, with FIG. 18 being a combined ballast release buoyant deployment break away keel release.

While the first two phases of the release action (counterweight and forward chamber) occur routinely, in the event of an emergency, the diver simply continues the same action into the third phase which results in the release of a centrally located weight. The central weights specific function combines with the central stowage of the counterweight, in offsetting any deterioration in comfort during the dive. As seen in FIG. 13, the central ballast is preferably an environmentally safe coated steel shot contained in a pouch and sized according to need, or alternatively, the central ballast can be a standard lead diving weight or lead shot. This third step, is notably only a partial release of diver 12's ballast. Its release nonetheless terminates the dive, and signals a more serious situation. By design, this release includes only a portion of diver 12's total ballast to facilitate the diver remaining in control of their ascent rate thereby reducing their risk of excessive accelerated buoyant ascent with its associated increased incidence of pulmonary barotrauma and consequent arterial gas embolization of the heart and/or brain.

In the event of an emergency warranting a release of ballast at depth, several signaling functions are concurrently deployed. The choice of which signaling functions are selected is dictated by the needs of the particular dive. The third phase release can detonate a compressed gas cylinder whose discharge through restricted orifice provides a slow flow into a small float ideally constructed from military specified brilliant orange high visibility fabric. As the bladder ascends it visually notifies the diver's buddy or neighboring divers of the need for assistance. Upon reaching the surface the float visually signals the dive master or dive boat operator of the onset of an accident. In addition to the visual alert the float provides an audible alert either through the detonation device (FIG. 8) or via an audible over pressure relief valve (FIGS. 8 and 9) which can be heard on ascent as well as at the surface notifying dive boat staff or others of the need for emergency assistance.

In the event of night diving, the same action can actuate a quarter turn strobe light signaling the diver's buddy. A second strobe may be attached to the released float signaling surface support of the emergency. The distressed diver is often hard to track or find once they are noticed to be missing. To facilitate the diver 12's buddy locating them while underwater, the third phase can rip open and release an orange or phosphorescent water dye, marking the distressed diver's course and current location facilitating underwater intervention.

The integration of at least one cervical bladder, but preferably a plurality of buoyant bladders into the diver's gear allows the diver to not only acquire comfortable and reliable airway protection through the addition of non-releasable tank mounted counterweight but also allows the diver to retain all their current releasable ballast.

Figure 6:
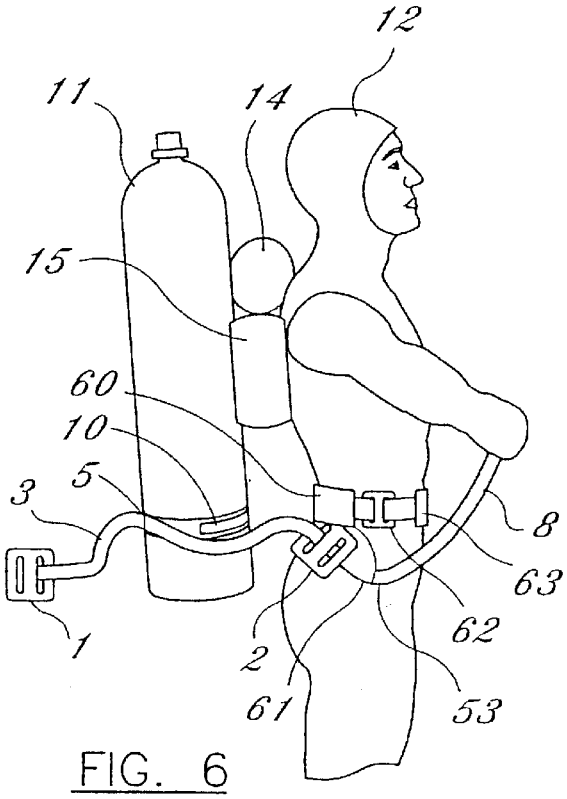
FIG. 6 is an alternate embodiment of that shown in FIG. 5.
Figure 7:
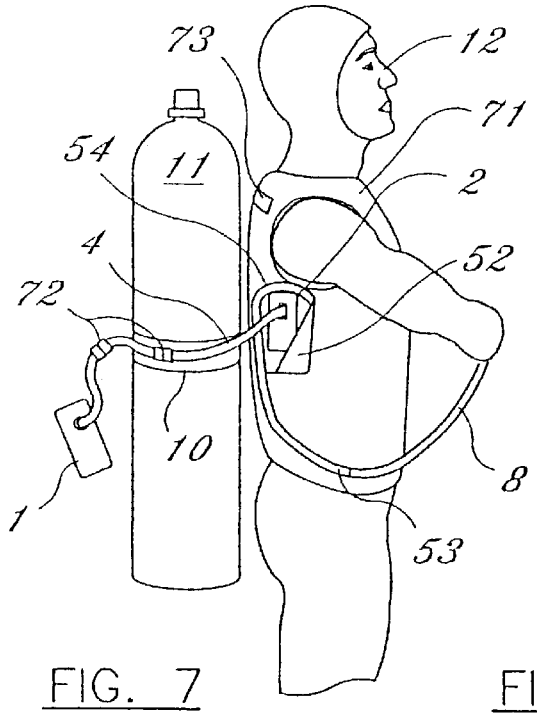
FIG. 7 is an alternate embodiment of that shown in FIGS. 5 and 6.
Figure 22:
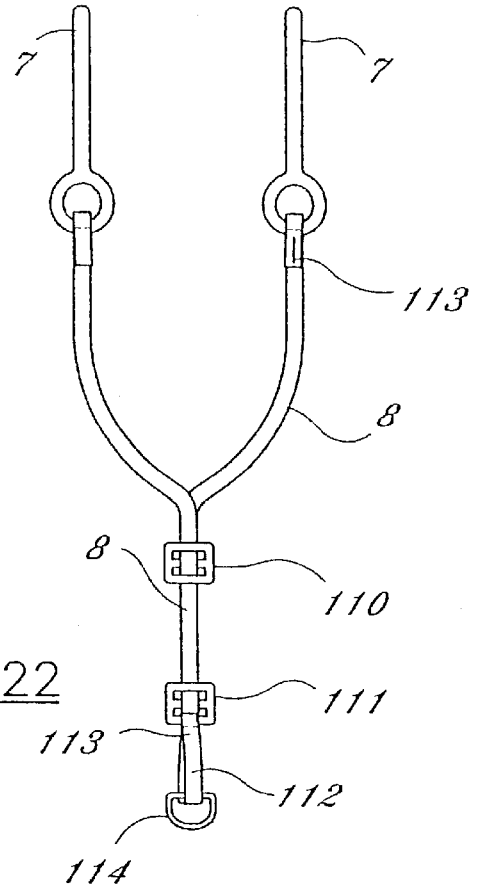
FIG. 22 is a perspective view of one embodiment for a rip cord harness for the present invention.

As seen in FIGS. 1 and 6, a primary fixed buoyant bladder is ideally a cervical pillow 14 where it provides hyperextension of the distressed diver 12's neck 13 opening the airway for spontaneous resuscitation, self rescue or just ease of respiration. Given the small size of bladder 14 it must be contained about the back of diver 12's neck 13 if it is to optimize freeboard, that distance from diver 12's nose and mouth and the surface of the water 16. The orally inflated bladder 14 or bladders 14 and 15 can be adjusted to provide whatever buoyancy is required to offset the ballast of airway protective counterweight 1 or 2, which routinely runs between 1 and 10 lbs. Unless the design of diver 12's Buoyancy Compensator is acceptable, a minimum of 4 lbs is preferred. The bladders simplicity of design and operation, in particular the lack of power inflators or over pressure relief valves, which fail by sticking open or closed, improves the diver's chance that the first four pounds of buoyancy when combined with the correct counterweight, provides superior airway protection. Since the bladder is not inflated at depth it will never contain pressurized air with its ability to rupture. For all these reasons the addition of small cervical bladder 14 supplies unparalleled redundancy of airway protection in the event of failure of diver distress or malfunction of the divers buoyancy compensator or air supply.

As seen in FIG. 6, if the buoyant offset is large enough it can be split between cervical pillow 14 and at least a second bladder 15 located between diver 12 and the tank or cylinder 11. Besides offsetting the counterweight 1 or 2's ballast, spinal bladder 15 moves some of diver 12's buoyancy in towards the distressed diver 12's axis of rotation thereby reducing the size of counterweight 1 or 2 required to achieve reliable self rescue rotation. Additionally spinal pillow 15 pads the diver 12's back from the back pack or tank or cylinder 11. Spinal pad 15 can come in a variety of shapes such as deployable mats or rafts. It is critical that if the secondary buoyant bladder offset is releasable that the size of counterweight 1 or 2 be determined without it being in place so that its removal from the diver personal gear does not result in the diver inadvertently loosing their heads up flotation.

Figure 10:
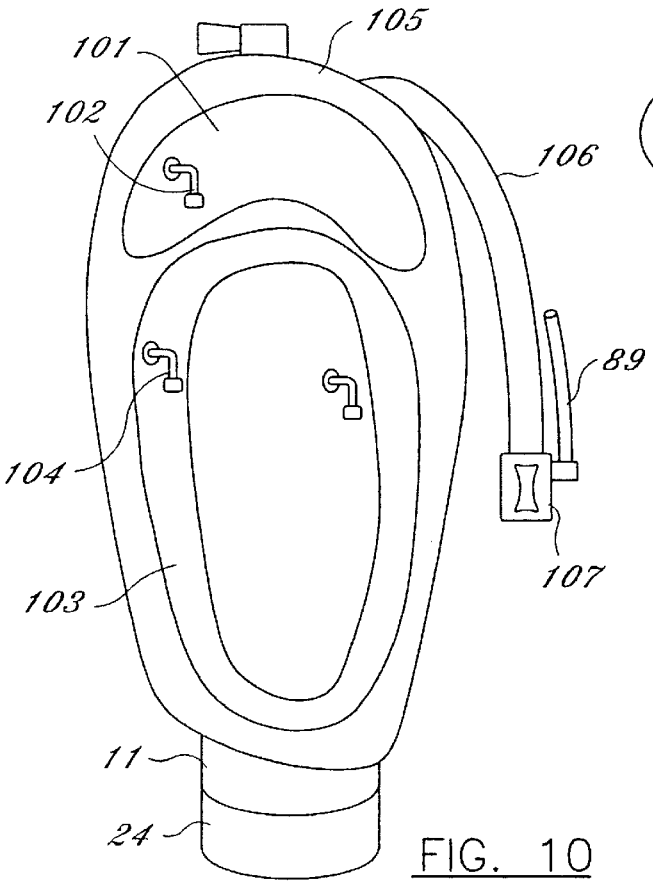
FIG. 10 is a perspective view of one embodiment of a buoyancy compensator illustrating the various buoyancy chambers.
Figure 12:
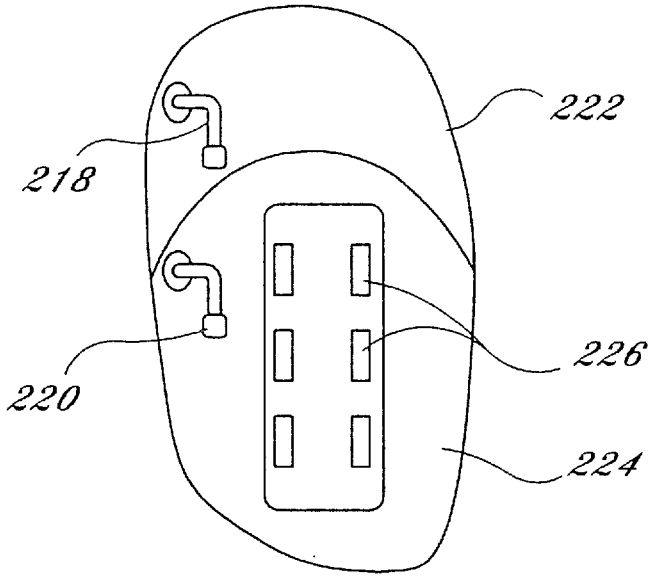
FIG. 12 is an alternate embodiment of that of FIG. 10 dual chambered buoyant offset.

If the buoyant cervical offset bladders is not built into the divers jacket (FIG. 10 illustrating the bladders built in), a single or multiple chambered orally inflatable heads up bladder is positioned and held in place by either a fixed or break away counterweight 1 or 2 that threads through the appropriate slots to position both the counterweight and cervical pillow (FIG. 12). A compressible member, such as foam, is preferably provided to generate tension in the counterweight's strap to keep both components in selected positions as previously determined by in-water testing while diver 12 is wearing all the gear to be used for a particular dive. The late addition of weight to a pocket to "submerge" often results in reducing a diver's airway protection from 100% to 10% and thus, no gear should be added after the counterweight's size and position have been established.

The diver's jacket is then positioned over bladder 14 and/or 15 and counterweight 1 and/or 2 where the jacket's cam buckle secures both components to the tank or cylinder 11. Preferably, the buoyancy offset is constructed from at least two if not more chambers. If the diver's jacket does not have a sufficient cervical pillow for hyperextension of the neck, it is recommended that the first 4–6 lbs of air be placed there. If the BC already has a large cervical pillow and there is no interest in redundancy, then the air can be placed in the lower chamber or chambers as needed to neutralize the counterweight's ballast and or balance diver 12 for reliable airway protection. Next the cervical bladder is filled, the counterweight is placed oh top, and the bladder deflated until the diver is just floating. Where the counterweight is less than four pounds, as maybe the case with steel tanks, it is recommended that at least 4 lbs of buoyancy be provided in the cervical pillow. After inflation the oral inflators are locked to prevent accidental deflation.

Alternatively, the offsetting buoyancy can be supplied by single or multiple layers of inherently buoyant closed cell foam, located about the neck of the tank or cylinder 11, built into the collar of the diver's jacket (FIG. 10) or layered as needed along the diver's spine and lumbar area or built into the shoulder straps or front of the jacket where it would contribute to reducing the size of the required counterweight. The buoyant means may also be supplied by a crush-proof rigid back pack that could be filled with varying combinations of water and air to achieve dive specific net buoyancy required to balance the diver's gear.

The bladders displacement or buoyancy is preferably determined and set before the dive, allowing each diver to adjust the amount of fixed buoyancy needed for the particular dive plan. It is important to determine, prior to the dive, whether the diver is diving in a bathing suit, wet suit or dry suit, using aluminum or steel tanks, using single or double tanks, strobe battery packs or other gear, all of which effect the need for either additional ballast or buoyancy and its positioning about the diver to achieve either continuous airway protection or for the advanced diver certified in ballast mediated airway protection, diver dependent releasable airway protection.

Concurrent deployment of the diver's independently operated or dive jacket integrated personal flotation device, such as those shown in the '233 and '454 Patents, also contributes to the rotational energy in both the first and second quadrants. Once in the face up position, the cervical collar, forward chamber, PFD and counterweight 1 and/or 2 combine to stabilize the distressed diver on their back (FIG. 1), opposing any wave action that might attempt to roll the diver back over into an airway submerged position. A diver floating on their back is unusual and when lying motionless signals distress and is likely to elicit active rescue and assistance. By contrast the diver floating face down at the surface may appear to be simply looking at the reef. However, minutes latter, assistance will be too late, when and if it arrives.

Figure 23:
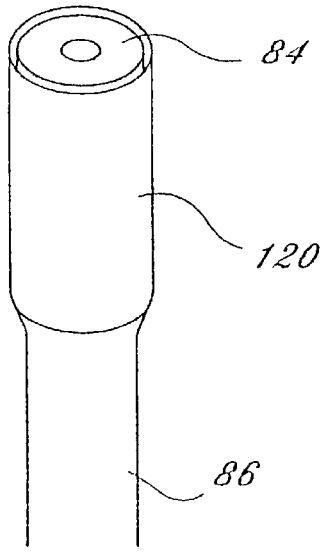
FIGS. 23 and 24 illustrate an oral inflator nipple.
Figure 24:
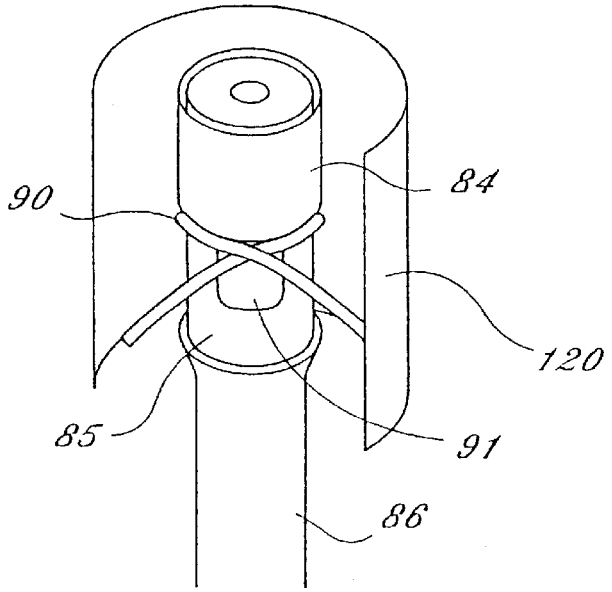
Figure 8:
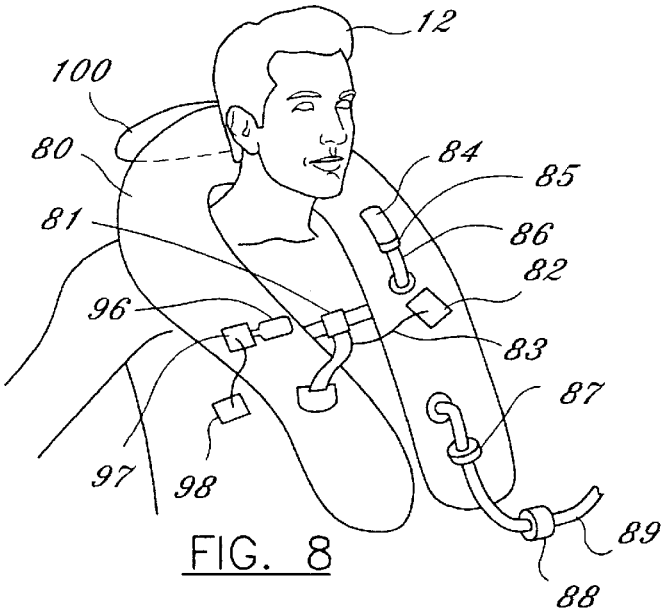
FIG. 8 is a perspective view of an embodiment of the present invention for use in a personal floatation device (PFD).
Figure 9:
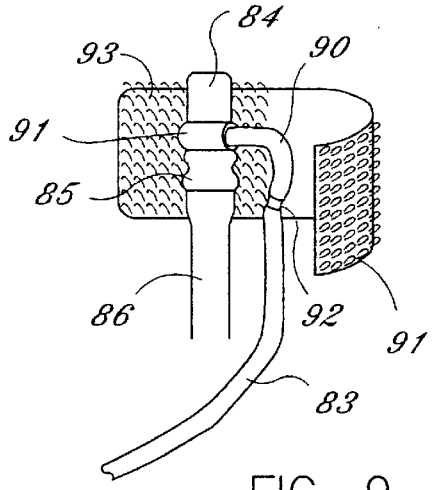
FIG. 9 is perspective view of an oral inflator and release cord for converting the valve to the normally open position preventing inflation of the PFD at depth.

The single handed closure 81 (FIG. 8) of the PFD chest strap accomplishes several functions in converting the PFD from its reliably deflated storage state into its fully inflated operation state. Closure of the chest strap accomplishes, amongst other benefits: (1) removing a retaining means that holds the PFD's combined Oral Inflator-Over Pressure Valve ("Inflator Valve") 84–86 (FIGS. 8, 23 and 24) in a normally open ("NO") position. The dual position normally open ("NO")/normally closed ("NC") Inflator Valve serves at least three distinct purposes. Oral Inflation, NO venting, NC allows inflation and then protects the bladder from over inflation. When NO-NC Inflator Valve is locked in the normally open position it continuously vents any extraneous air that may move from the rear chamber forward preventing accidental inflation at depth. During routine operation if the diver attempts to over fill the dedicated buoyancy compensation chamber, the excess air will stream out the NO Inflator Valve in front of the diver where it serves as a visual and audible signal that the diver has exceeded full displacement and is wasting valuable air. Upon deployment of the PFD, the valve is converted to a normally closed operation where it allows the PFD to retain air and allow inflation to full displacement, and protects the PFD from over inflation in the event the PFD was deployed at depth where it would have been filled with pressurized air that may double or triple in volume on ascent; (2) opening of the PFD's fabric valve retaining the PFD in the deflated state during the dive, thus, preventing the PFD from filing with air inadvertently; (3) bringing the two frontal chambers of the PFD in towards the centerline, where their combined buoyant moment strongly rolls a distressed diver 12 through the first quadrant of the Self Rescue roll, and assists in rotation through the second quadrant and then assists in stabilizing diver 12 in the face up position (FIG. 1); and (4) tightening the PFD about the chest of the diver, for optimal operation of the PFD's buoyancy as well as for preparation for separation from the diver's gear if indicated.

If the PFD is to be separated and used independent of the diver's tank mounted counterweight 1 or 2, the inflatable PFD must include it's own separate and sufficient ballasting moment or the PFD will provide inferior airway protection compared to its performance while attached to the diver's safe or compensated cylinder.

The release of the diver's PFD accelerates the Self Rescue roll in both the first and second quadrants. Once in the face up position, a majority of it's displacement is out of the water where it strongly opposes any effects of the sea state to roll distressed diver 12 back over onto their face.

For the advanced diver, trained in the principles of ballast mediated airway protection and capable of the additional task loading demanded when the diver assumes full responsibility for the conversion of equipment mediated face down flotation into face up flotation, the disclosed break away counterweight 1 or 2 is a dramatic improvement in underwater comfort which will allow increased usage of counterweight 1 or 2 with its improved airway protection. The fixed counterweight system described in the '233 and '454 Patents, still should be used by the beginning diver who has yet to acquire the experience in the ballast mediated airway protection when diving with a face down dive jacket until they choose to deploy face up positioning in response to an emergency.

The break away counterweight 2 stows the ballast needed to turn diver 12 into a heads up position in an inactive state, close to the diver 12's longitudinal axis of rotation. If a particular diver and his or her gear require six (6 lbs) pounds mounted on the back of cylinder or tank 11 to achieve 100% reliable heads up surface positioning, that same six (6 lbs) pounds counterweight will not work when stowed close to the axis of rotation because the lever arm is significantly shorter. Once released, counterweight 1 drops away from neutralized central attachment near the diver 12's axis of rotation out towards counterweight 1's posterior attachment point. Once released the same 6 pounds becomes capable of actively rolling the distressed diver 12's face out of the water into a heads up position. The advantage of stowed counterweight 2 is comfort which is essential to its acceptance by the advanced diver. However, the. diver assumes 100% responsibility for pulling counterweight 2's rip cord 8 before they can access counterweight 1's acquired airway protection.

Figure 11:
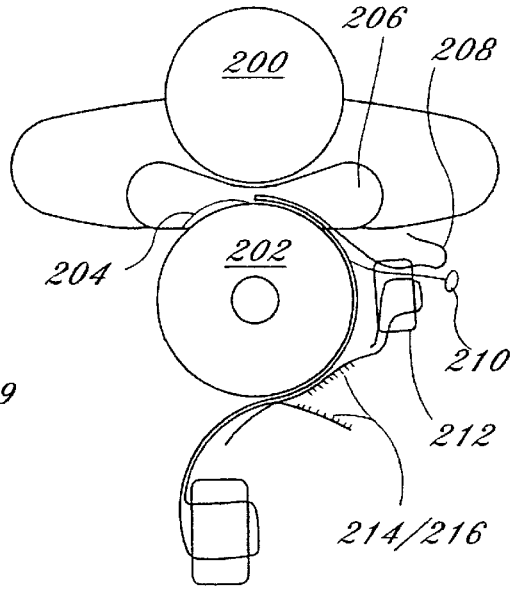
FIG. 11 is a top plan view of one embodiment of the present invention break away keel viewed from above the diver.
Figure 14:
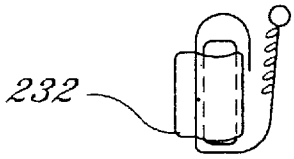

FIG. 11 is a top view of the break away keel invention showing head 200 of the diver, tank 202, compressible foam 204, cervical pillow 206, rip cord 208, pull pin 210, keel 212 stowed an in an inactive position, hook fastener 214, loop fastener 216, and keel 212 stowed in a released active position. FIG. 12 shows the dual chambered buoyant offset having an oral inflator 218, locking cap 220, first bladder 222 forming the cervical pillow, second bladder 224 and slots 226 for fixed or break away keel band. FIG. 13 illustrates the standard dive weight coated steel shot or lead shot 228 and military spec brilliant orange inside 230. FIG. 14 illustrates the large side flaps accommodate two-six pounds of keel offset and-a BC or weight belt 232 having a two inch loop.

Figure 15:
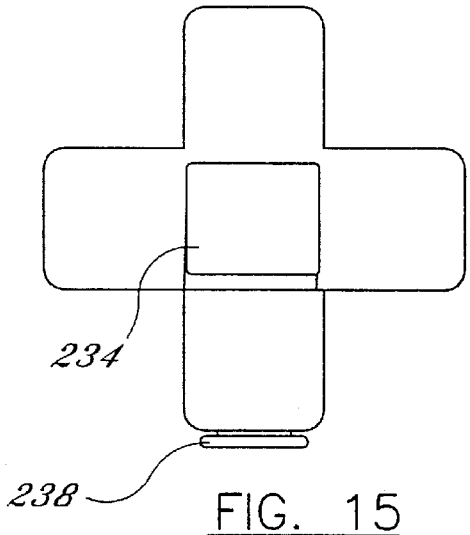
Figure 16:
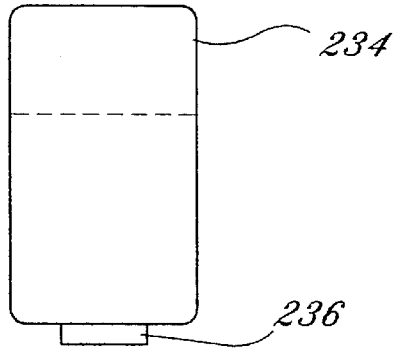
Figure 17:
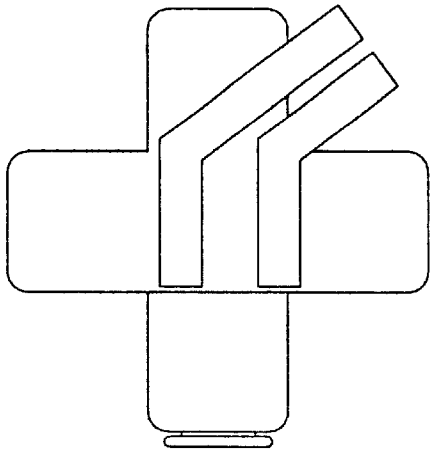
Figure 18:
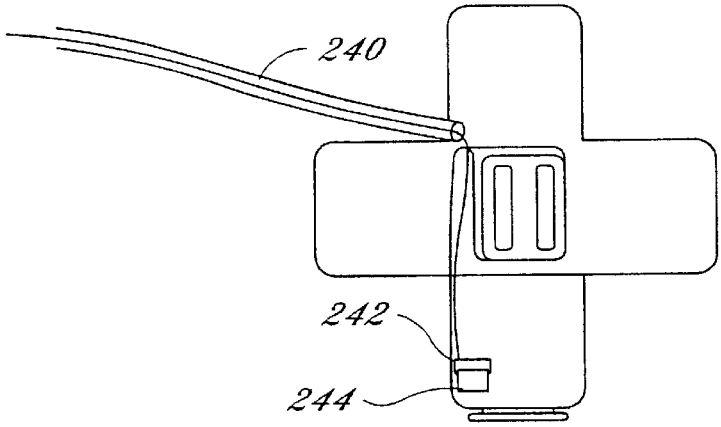
Figure 19:
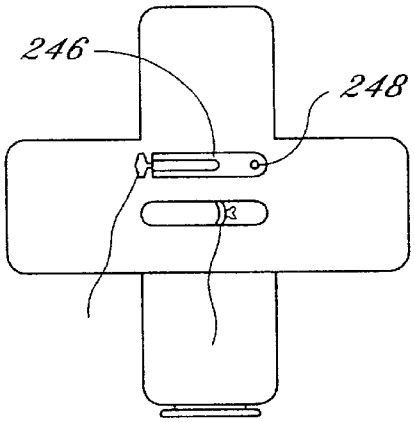

FIGS. 15, 16 and 17 illustrated a single fold forward chamber 234 having a weld cut (FIG. 16), reduce by one-third. A tail 236 is left to sew into bottom seam. A four inch hook fastener can be provided on the inside and a four inch loop fastener on the back side. A high visibility rip handle 238 is provided. FIG. 18 shows a combined ballast release, buoyant deployment and break away keel release, having a counterweight release 240, d-ring 242 and hook and loop fastening alligator 244. FIG. 19 illustrates a CO2 float-slow flow orifice 246, audible overpressure relief valve 248, as well as a one-quarter turn strobe atop of the bladder for night diving which is associated with the back.

Figure 20:
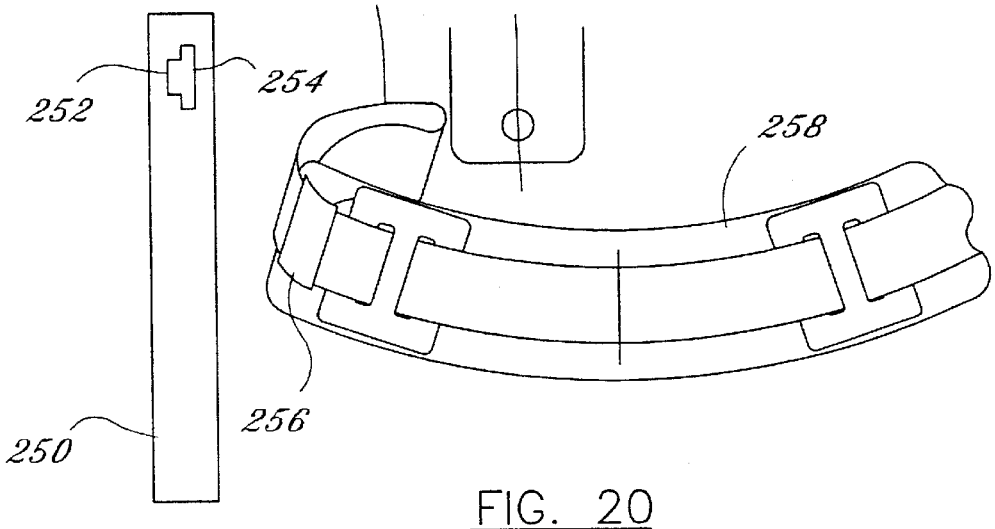

FIG. 20 illustrates a side of a tank track 250 with an oversized addition 252 for back strap (1¼" to 1½") and a current two inch guide 254. A one inch quick release triglide 256 for tensioning is also illustrated. Tank band 258 shown in FIG. 20 is attached midline. In use, the tank bands are attached, and the keel is snapped on snug (where snugging 2–4 pounds/per side, no cam action is required). An inside one inch orange/silver reflective line ribbon for visual warning can be provided.

Figure 21:
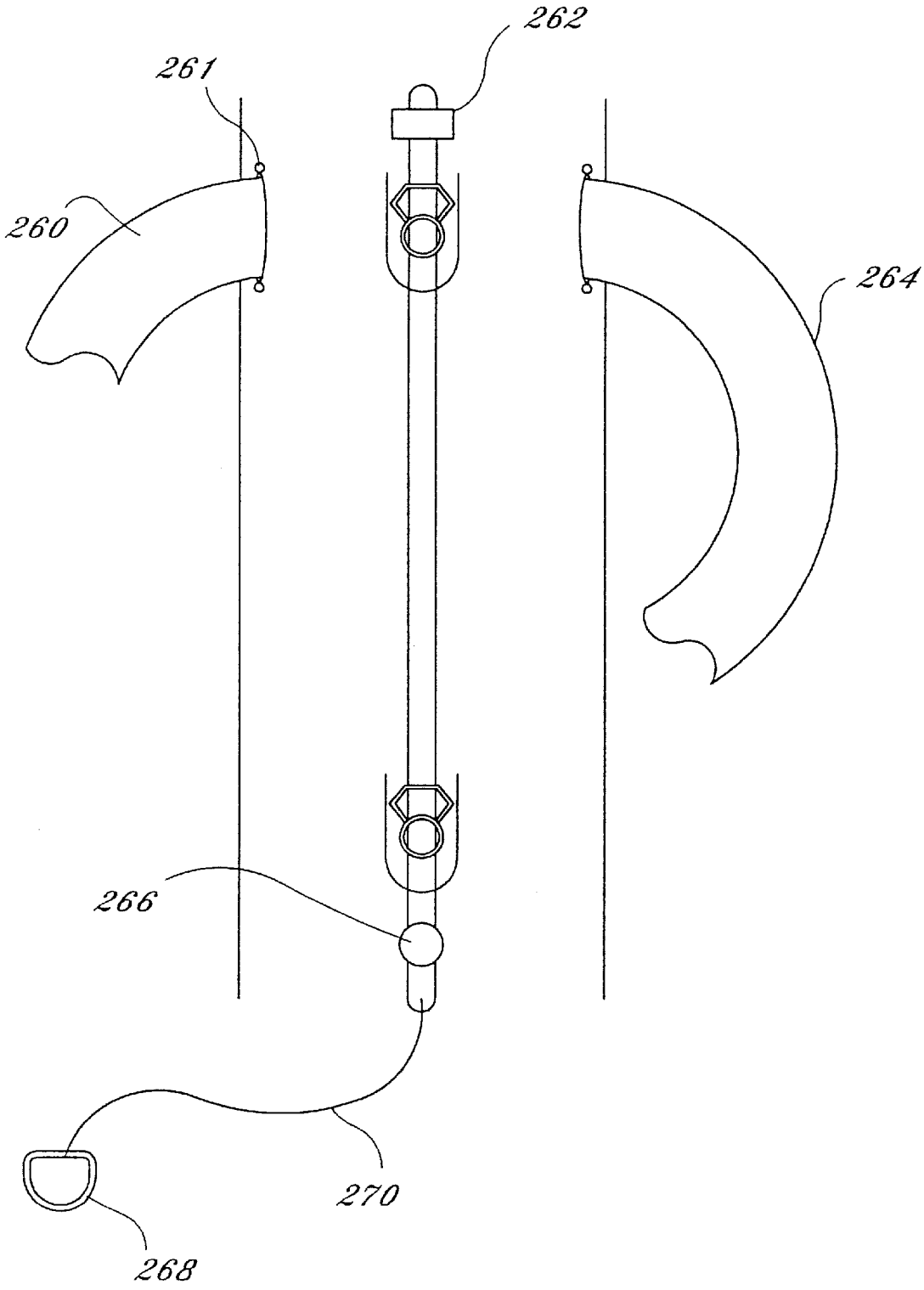

FIG. 21 illustrates a cam buckle 260, retaining bolt 261, stop 262, tank band and back strap 264, guide eye bolt or enclosed single pulley 266, large d-ring 268 (pulled straight down). An eye bolt, lock nut on reverse cap nut can be provided for finish. A double wire 270 can be provided if course with inside slides, however, it may be susceptible to corrosion. Alternatively, a single stainless wire can be provided and retained by hook and loop fastening strap.

Figure 25:
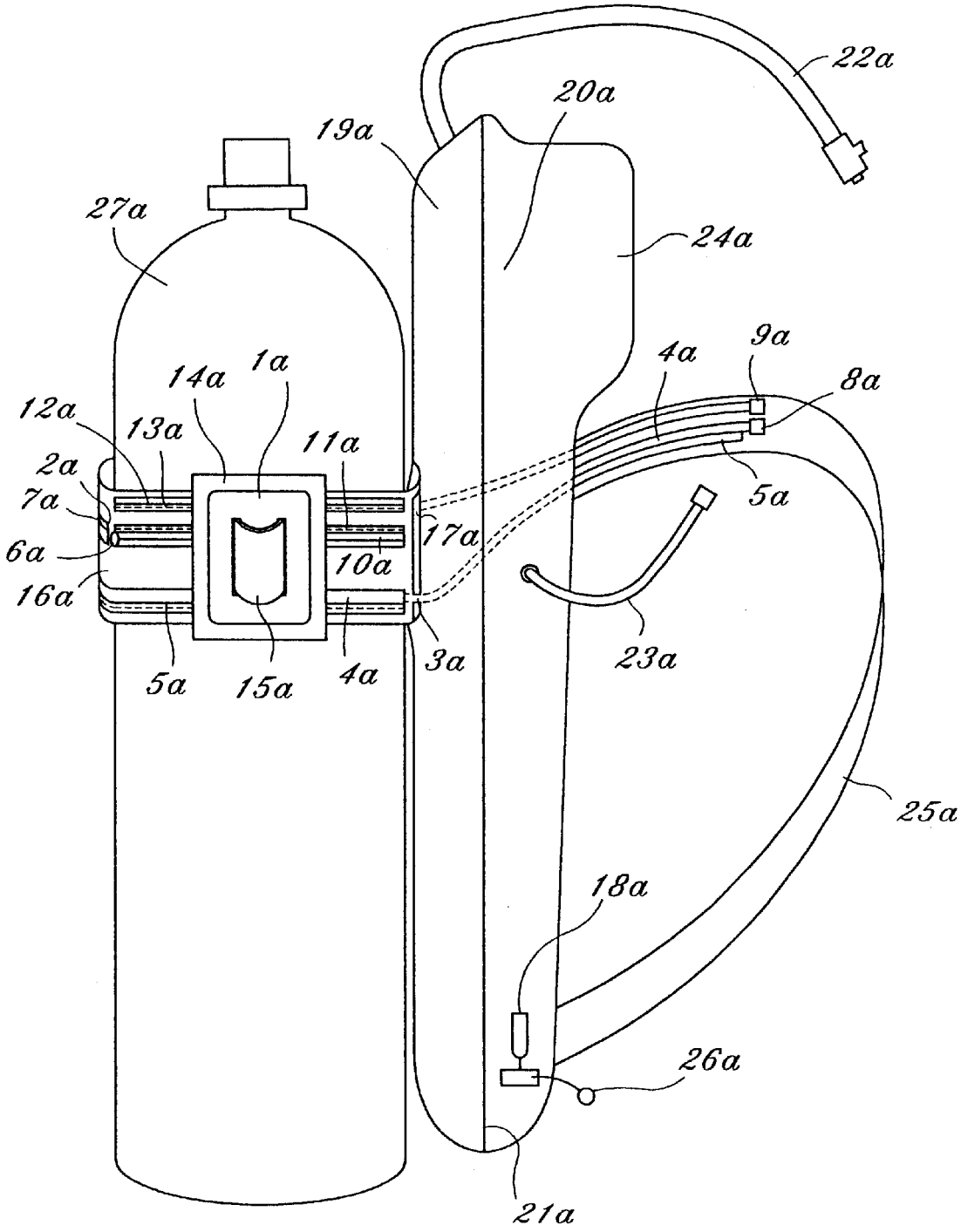
FIG. 25 illustrates a SCUBA diving personal flotation device combined with buoyancy compensator relying upon redundant and reversible dual position dual function break away counterweight/keel embodiment of the present invention with the keel shown in a midway position.

As seen in FIG. 25, the present invention also provides for a SCUBA diving personal flotation device combined with buoyancy compensator ("BC") relying upon redundant and reversible dual position dual function break away counterweight/keel. United States Coast Guard regulations require that any product tested and approved to perform as a Life Jacket meet several tests. The approved PFD must roll the unconscious user from any position into an airway-protected position in less than 5 seconds. It must supply 120 mm of freeboard between the waters surface and airway. It must maintain the wearer in a specific head and torso angle and must have a face plane that if it lists to one side must maintain sufficient freeboard. This present invention provides a device that satisfies these regulations and which can be provided to recreational divers.

Automatic and manual inflatable life jackets have been recently approved for boating. A water activated PFD-BC would not work due to the submerged environment in which the personal flotation device ("PFD") operates. Therefore a manually operated inflatable PFD is the preferred category. Certain classes of inflatable life jackets with a single chamber are distinguished by the amount of displacement. In order to be rated as a Type I Off Shore PFD by USCG they jacket must provide 35 lbs. of buoyancy. While the safety of life at sea ("SOLAS") class inflatable PFDs do not have a displacement requirement they do require redundant chambers and redundant power inflation means in addition to oral back up inflation capability. A SOLAS Type I Off shore requires both criteria be met.

The dive jackets of the present invention can be classified as a Type I PFD if it generates 35 lbs. of buoyancy, a Type II if it provide 24 lbs. of buoyancy of Type III if it provides 16 lbs. of buoyancy. While SOLAS currently requires two distinct chambers the present invention jacket, which relies upon an inner wall that is common to the two outer walls, satisfies such requirement as the inner wall cannot be subject to any puncture that must not first penetrate one of the outer walls. If there is a de novo failure of the coated fabric separating the two chambers the outer walls are still left intact.

Since the diver's inflatable jacket is used frequently they are often constructed out of 1000 denier ballistic cloth, though such is not limiting. Nonetheless the fear of the USCG regarding all inflatables is concern about damage to the integrity of the chamber i.e. puncture or abrasion. Besides incredibly rugged construction and use of very heavy fabrics, the diver's single chambered Type III PFD-BC is inflated before and during every dive. Any leaks can be detected when it is functioning as a recreational BC before the product might pressed into service in an emergency as a life jacket. Thus, the diver's inflatable jacket is preferably checked by power inflation before every use. Routinely the chamber is inflated to the maximum volume and pressure as evidenced by the release of air via the high bore over pressure relief valve. While some emergencies occur during the dive, the vast majority occur at the end of the dive when the diver is tired. By that time the chamber's integrity to function as a PFD is confirmed by use during the dive. If the BC is leaking, the dive can be called off early on while the diver is fresh and has the physical and mental reserves to handle an emergency.

One cross benefit of a SOLAS class PFD-BC is that the separate chambers with redundant inflation means provides additional back up to manage both under water emergencies as well as traditional PFD surface emergencies. Thus the redundancy serves dual benefit for the diver. The redundant chamber covers the unlikely failure of the BC's primary chamber both under water and at the surface. Under water the redundant chamber can serve to assist the diver in reaching the surface, as well as providing the diver with airway protective positioning at the surface in the event of loss of consciousness.

Another benefit of the concurrent PFD-BC besides testing prior to every use is that the BC is preferably serviced annually to evaluate the bladder, valves and inflator. This annual professional servicing assesses the inflation mechanism for corrosion or wear and tear and supplies preventative replacement. The routine power inflation and annual servicing confirms operability so that in the event of an emergency the mechanism will more likely work than an inflatable life jacket of similar life that has not been inflated in years. More often than not the inflatable PFD has been stowed in a lazzerette for years possibly suffering UV, chemical or mechanical damage from storage unassessed until relied upon in an emergency.

As disclosed in issued patents and pending patent applications of the inventors, ballast plays a critical role in the efficacy of any buoyant product whether boat, life jackets or diver's jacket, and other dive equipment. The diver's PFD-BC is truly a special case life jacket because the entire sport occurs not on top of the water but beneath the water. Further scuba diving is more enjoyable when the diver is stabilized in a face down position while underwater. However, this same face down position while convenient when taking macro photographs of coral polyps is lethal in the event of loss of consciousness at the surface.

As discussed above, a simple, dual position, dual function ballast mechanism that allows the diver to enjoy face down positioning while under water and yet upon release the BC is converted into an airway protective life jacket is provided by the present invention. Given the significant rate of drowning at the surface during recreational diving, the option to convert the BC airway submerging face down position into an airway protective position represents a significant advance in safety for the recreational diver. The above described dual position ballast is preferably used once per dive. Once the trim weight is freed, it drops to the back of the tank requiring the diver to remove their gear before they can re-secure the keel weight back into its trim weight position.

An another embodiment of the present invention is shown in FIG. 25 and discloses a reversible dual position dual function trim-keel weight that allows the diver to enter the water with the weight in the active position so that they have a life jacket on. Once in the water and comfortable that all their gear is in good working order and all members of the dive party are ready to undertake the dive, the keel weight can be inactivated by returning the keel weight back into its inactive trim weight position. In this position the diver does not have to fight a tank trying to turn him over onto his back during the dive while underwater. If the diver wishes to return to the boat, such as for a second roll of film, the keel/counterweight can be preferably deployed for the ascent, which is where the majority of arterial gas emboli ("AGE") occur. On occasion an AGE occurs without evidence of violating any of the dive rules and is called an 'Undeserved Hit'. The primary presentation of AGE is loss of consciousness. Rather than task load such an emergency with the need for an additional action such as converting the BC into a PFD by deploying the keel, the diver's habit of putting on his or her life jacket on or before every ascent can be preventative. Thus the diver has one less thing to do in the event the BC's power inflator sticks and they are rocketing to the surface exposing them to rapid expansion of air in the lungs that precedes the pulmonary rupture of air into the arterial blood supply.

If the ascent is without event and the diver reloads their camera, they can then retract their keel into the trim position and complete their dive without having to remove and re-arm their break away keel.

The ballast mechanism disclosed herein simultaneously improves both performance and safety by allowing the ballast means to move reversibly back and forth along a mechanical guide such as a track, in accordance with the changing needs of a dive plan. The track member also allows the trim weight to be converted into an airway protective keel weight without having the weights swinging freely about the back of the tank. The track member also allows the keel to be reconverted into a trim weight. Thus, functionally the diver can put on their life jacket when indicated and take off their life jacket when preferred, as many times as it serves to enhance not only their safety but also their enjoyment during a dive.

Spring or pneumatically powered devices may be used in moving the ballast out or in during the course of a dive. However, a simple mechanical mechanism discussed below can serve the same reversible function with less chance of failure and at a lower cost, thereby improving the chances of its inclusion on low cost BC's so that the safety of a PFD-BC can be enjoyed by all divers.

As seen in FIG. 25, the diver operates the reversible dual position keel system preferably by a handle accessible which be. disposed at the front of the jacket, though such location is not limiting. The handle can be easily accessible to both the diver or their buddy, should the buddy be called upon to deploy it in an emergency, but can be partially covered to prevent the handles from being snagged underwater and accidentally deploying the keel. A quick release buckle or other similar release mechanism can both serve as a unified handle and lock the handle from accidental deployment.

While a single handle can operate either a single or dual keel system, a split handle can also be provided to allow simultaneous or independent operation of one or both ballast members. Preferably, though not limiting, both portions of a split handle are simultaneously pulled out to deploy the keel and thereby acquire the airway protective benefits of a PFD. Alternatively, the connection means is pushed in to relocate the keel from its active posterior position to its anterior. inactive trim weight position. While a single keel-trim weight can be sufficient to acquire the benefits of a PFD-BC, a dual system confers a level of redundancy in the event one of the tracks jams preventing deployment of one of the keels. The dual system can also be intentionally operated separately to achieve partial trimming of the dive plane. However, the primary important reason for a dual system is redundancy of airway protection. That is either one or the other keel weight is sufficient to achieve ballast mediated airway protection in the event one track should stick or jam.

A flexible member can connect the handle with the ballast. The flexible connection member slides through tracks having a slightly larger guide tube, which protects the connecting member from being pinched or bound along its course. Preferably, though not limiting, the guide tube has a sewable flange so that the course could be secured to the jacket along the way.

Once the connection member leaves the shoulder and BC it ideally splits to travel in opposite directions around the outside of the tank. The connection member and its protective guide tube can be secured to a tank band of variable composition. Preferably, though not limiting, the tank band is secure from the anterior side of the tank leaving the lateral and posterior aspects of the tank free of obstructions to the variably positioned trim/keel weight.

Near the posterior aspect of the air tank the connection member exits the guide tube and enters the trim/keel track. The keel track is preferably secured to an attachment member encircling the tank. The keel track can be open on the outer face allowing the connection member to be attached to an exterior mounting means that secures the ballast. The combined connection member-mounting member can be variably positioned from the anterior aspect of the tank where the ballast acts as an inactive trim weight to the posterior tank where the same ballast acts as the keel. As the trim weight is pulled into the keel position its distance from the axis of rotation increases. It is that increased distance that leverages the same amount of ballast from inactive to active. In the active position the keel orients the buoyant member of the inflatable jacket into a face position.

The ballast mounting member that is preferably attached to the end of the connection member can range from a strap to a plate or a pocket to contain either variably sized shot ballast, block ballast or other dense object(s). The connection member reversibly locates the ballast mounting member which variably shifts the center of gravity away from or towards the back of the diver, thereby creating face up positioning or face down positioning as so determined by the operating diver.

Alternatively, track mounted, variable position, variable function ballast systems might rely upon a pneumatic ram to move the keel out or in. Or the keel could be pushed back along the track by compressing a spring which can be released by the diver. Other similar systems can be used to securely guide the movement of the trim weight into the keel weight position in either a singe use of reversible use fashion. All of these systems accomplish the same effect, the conversion of face down positioning into face up positioning either once during a dive or variably throughout the dive.

Since the connection member which slides through the mounting track means raises the ballast away from the tanks surface. A spacer member above and/or below can be provided to support the ballast mounting member away from the tank and prevent it from flopping about the mounting track. Alternatively the connection member can bifurcate and be secured to the ballast mounting member at two positions, which would likewise stabilize the variable position keel to the tank.

It is envisioned that the connection member proceeds to the rear of the tank before connecting to the mounting member so that the critical actuation of the keel occurs as a result of pulling the trim weight into the keel weight position. However, alternatively, the trim weight can be pushed by the connection member from the inactive trim position into the active keel position, with less strength applied in the push direction. However, where the device is pneumatically driven, then an anterior attachment can give the mechanical advantage to deployment. Furthermore, if one leg of the track is more inclined to jamming or failure it is best that that leg be in the conversion of airway protection to airway submersion, i.e. active to inactive. Therefore in the event of failure, the keel is left deployed that is the diver's keel remains in the airway protective face up position until the mechanism is serviced and restored to full reversible function.

The track can conform to the shape of the track. Preferably, the track is constructed from plastic, though such is not limiting. The can be incorporated into the tank itself, the tank strap, the tank boot, the tank net, etc. Furthermore, a single weight can be provided. Additionally, the location of the track can be across the bottom of the tank, around the neck of the tank, around a middle portion of the tank, diagonally disposed with respect to the tank, etc. The ballast member in an inactive position can also be stowed on the bladder.

Some of the features, though not limiting, of the SCUBA diving personal flotation device combined with buoyancy compensator relying upon redundant and reversible dual position dual function break away keel/counterweight include: (1) bilateral reversibly positioned ballast member; (2) single sided reversibly positioned ballast member; (3) connection member allowing remote movement between active and inactive positions; (4) connection member operable from the front of the diver's jacket; (5) track member to guide ballast; (6) ballast mounting member for attaching shot or block ballast; (7) reversibly operated ballast mounting member; (8) single release device track guided dual position ballast member; (9) single release device track guided dual position ballast member cocked from behind; (10) single release device track guided dual position ballast member cocked from front; (11) single sided single track mounted ballast; (12) single sided multiple track mounted ballast; (13) bilateral single track mounted ballast; (14) bilateral multiple track mounted ballast; (15) one or more tracks mounted on one or both sides; (16) one or more tracks mounted on bottom; (17) one or more tracks mounted around top valve stem; (18) single ballast track guided member; (19) multiple ballast track guided device; (20) ballast permanently mounted to connection member; (21) ballast releasably mounted; (22) ballast manually moved along track; (23) mechanically powered ballast moving device; (24) spring or pneumatically powered ballast moving device; (25) two chambers sharing common wall; (26) common wall welded along entire perimeter of bladder; (27) anterior bladder redundant bladder with cephalo-cervical pillow that inflates to place head into approximately 30 degree angle; and (28) distinct inflation member for each chamber.

The following is a sequential list of reference numbers illustrating various features in FIGS. 1–24:

1) Non-releasable multiple position counterweight in second active position;

2) Non-releasable multiple position counterweight stowed in inactive position;

3) Non-releasable multiple position counterweight swing arm in posterior active position;

4) Non-releasable multiple position counterweight swing arm in anterior inactive position;

5) Midline attachment point for single or multiple swing arms;

6) Catch means for securing release means, Adjustable position loop accommodating quick; release pin;

7) Quick release means e.g. Pull Pin;

8) Rip Cord, allows remote activation of quick release means;

9) Variable position means to tension a wide range of design, size and shaped diver weights;

10) Variable position tank band accommodating tanks of varying circumferences;

11) Diver's Tank or Air Cylinder;

12) Diver;

13) Hyperextension of diver's flaccid neck;

14) Cervical buoyant means;

15) Lateral buoyant means;

16) Water Line below diver's airway;

21) Adjustable Closure means for accommodating wide range of ballast;

22) Attachment means for securing counterweight pouch to swing arm and tensioning pouch to tank;

23) Counterweight Pouch's Quick release component for releasable stowage in the inactive; anterior position;

24) Tank Boot;

25) Double locking means to increase security of attachment of counterweight to midline position;

30) Dual position counterweight adapted to utilize diver's traditional dive weights;

41) Friction retainer recess;

42) Adjustable friction means, thin to thick varying durometer O-Rings;

51) Diver's Jacket;

52) Quick release means for containing inactive counterweight at axis of self rescue rotation;

53) Closure means for pouch attached to rip cord, double sided velcro loop;

54) Complementary closure means affixed to dive jacket, velcro hook, zipper, snap, loop and pin, etc.;

60) Dual position non-releasable counterweight containment means built into or attached onto the diver's weight belt;

61) Releasable retaining means, pocket flap with complementary attachment means, velcro, zipper, snap, pin etc.;

62) Releasable submerging ballast, traditional dive weight on weight belt;

63) Quick release weight belt buckle;

71) Jacket, vest, harness, wet suit, dry suit;

72) Multiple position swing arm with integrated quick release coupling means;

73) Counterweight fixed position or multiple position upon release built into buoyant thermal; means for improved surface positioning of wet suit/ dry suit wearer such as surfing, kayaking, swimming;

80) Horse Collar bladder or Inflatable personal flotation device, USCG Class III;

81) Chest strap closure means;

82) Quick release means for securing over pressure valve in open position;

83) Release cord for converting valve into normally closed position;

84) Oral inflator nipple;

85) Over pressure relief valve fixed or adjustable position;

86) Oral inflation tube for PFD;

87) Check valve with or without single pressure relief setting or Check valve with or without variable pressure relief setting;

88) Quick release coupling means for detaching form air supply;

89) hose to gas supply;

90) Dual position spacer means, hold valve open;

91) valve in open;

92) attachment of cord to enclosure means;

93) Quick release Containment means complementary attachment means such as Velcro Hook;

94) Quick release Containment means complementary attachment means such as Velcro Loop;

95) Quick release Containment means keeping cord in position locking valve open;

96) Compressed gas;

97) Detonator means;

98) Pull for activating detonator;

100) PFD counterweight, fixed or multiple position upon activation;

101) Cervical collar, inflatable or inherently buoyant means built or welded inside or outside of diverts buoyancy compensator, maybe added onto to existing dive jackets;

102) Oral inflator to achieve 4 lbs plus what ever is necessary to offset the ballast required to counterweight the diver;

103) Lower Buoyancy offset, inherent or inflatable;

104) Oral inflator;

105) Diver's inflatable buoyancy compensator dive jacket;

106) Diver Jacket power inflator;

107) Dive jacket oral or power inflator;

110) Triglide for rip cord harness Y length adjustment-(Small Y for low location, large Y adjustable for counterweight located high on the tank and therefore requiring the individual arms to travel around dive jacket before combining into single rip cord);

111) Triglide for adjusting overall length of rip cord as needed for counterweights varying location;

112) Rip cord length adjustable loop allows 50% variation in length from triglide 110;

113) Stitch;

114) Pull/snap; (Used in tandem, triglides 110 and 111 allow the harness to accommodate different lengths from left and right counterweight to 114 pull/snap);

120) Mylar containment mechanism that also allows overpressure valve to be switched between open and closed.

The following is a sequential list of reference numbers illustrating various features in FIG. 25:

1*a*) Right Variable Position Ballast;

2*a*) Right Ballast Connection means;

3*a*) Left Ballast Connection means;

4*a*) Left Connection Guide Tube means;

5*a*) Left Connection Guide Tube Attachment means;

6*a*) Right Connection Guide Tube means;

7*a*) Right Connection Guide Tube Attachment means;

8*a*) Left handle;

9*a*) Right handle;

10*a*) Right Variable Position Ballast Track means;

11*a*) Right Variable Position Ballast Track Attachment means;

12*a*) Right Shim means;

13*a*) Right Shim Attachment means;

14*a*) Right Ballast Mounting means;

15*a*) Right Ballast securing means;

16*a*) Tank Mounting means;

17*a*) Tank Mounting Securing means;

18*a*) Redundant Air supply for emergency inflation or bail out;

19*a*) Rear Buoyancy Compensation Chamber;

20*a*) Forward Emergency redundant Chamber;

21*a*) Common welded seam combining rear, middle and forward fabric layers;

22*a*) Oral and power inflation means for working bladder;

23*a*) Oral inflator of emergency redundant chamber;

24*a*) Cephalic pillow baffle of emergency redundant chamber;

25*a*) Shoulder Straps;

26*a*) Redundant Air supply for emergency inflation actuation means; and

27*a*) Air Cylinder.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination ballast and buoyancy assembly for aiding in heads up surface positioning of a user, the combination ballast and buoyancy assembly comprising:

a mounting member secured to a user's dive gear;

at least one weight member attached to said mounting member, said at least one weight member stowed in an inactive first position and released to an active second position; and a buoyant member associated with the dive gear separate from said at least one weight member;

wherein in said released active second position said at least one weight remains attached to said mounting member and said mounting member remains secured to said dive gear.

2. The combination ballast and buoyancy assembly of claim 1 wherein said buoyant member is inflatable.

3. The combination ballast and buoyancy assembly of claim 1 wherein said at least one weight member is attached to the mounting member by fabric, spring steel, or a rigid arm that can occupy two or more different radii from the combined axis of rotation.

4. The combination ballast and buoyancy assembly of claim 1 wherein said buoyant member is an orally inflatable bladder that is positioned to focus buoyant energy about a user's neck in an emergency situation.

5. The combination ballast and buoyancy assembly of claim 4 wherein said orally inflatable bladder is attached to a dive jacket worn by the user.

6. The combination ballast and buoyancy assembly of claim 1 wherein said buoyant member is an at least partially inflated float or raft positioned between the user and an user's as cylinder.

7. The combination ballast and buoyancy assembly of claim 1 further including at least one additional buoyant member associated with the dive gear.

8. A combination ballast and buoyancy assembly for aiding in achieving heads up surface positioning of a user, said device comprising:

a ballast assembly having at least one weight member and a mounting member, said mounting member secured to a user's dive gear, said at least one weight member attached to said mounting member;

wherein said at least one weight member is stowed in a first inactive position and released to an active second position;

a buoyant member associated with the dive gear separate from said at least one weight member;

wherein said at least one weight member is stowed closer to a use's longitudinal axis of rotation in the first position and is releasably dropped to the second position which is a posterior point of attachment where said at least one weight member supplies energy in combination with said buoyant member to aid in supplying an airway protective righting moment.

9. A device for aiding in achieving heads up surface positioning of a user, said device comprising:

a ballast assembly having a ballast member and a mounting member, said mounting member secured to a user's dive gear, said ballast member attached to said mounting member;

wherein said ballast member is stowed in an inactive first position and released to an active second position;

wherein in said released active second position said ballast member remains attached to said mounting member and said mounting member remains secured to said dive gear.

10. The device of claim 9 wherein said dive gear is a gas cylinder.

11. The device of claim 9 wherein said ballast member is attached to said mounting member by fabric, spring steel, or a rigid arm that can occupy two or more different radii.

12. The device of claim 9 further comprising a first buoyant member associated with the dive gear separate from said ballast member.

13. The device of claim 12 further comprising a second buoyant member associated with the dive gear separate from said ballast member.

* * * * *